United States Patent [19]

Herzog

[11] 4,230,259

[45] Oct. 28, 1980

[54] SELF-LOCKING CARTONS

[75] Inventor: Milton W. Herzog, Valley Stream, N.Y.

[73] Assignee: H. Goodman & Sons Inc., Kearny, N.J.

[21] Appl. No.: 45,214

[22] Filed: Jun. 4, 1979

[51] Int. Cl.[3] ..... B65D 5/08; B65D 5/06

[52] U.S. Cl. ..... 229/38; 206/806

[58] Field of Search ..... 229/38, 45; 206/806

[56] References Cited

U.S. PATENT DOCUMENTS

| | | | |
|---|---|---|---|
| 1,135,588 | 4/1915 | Kendrick | 229/45 X |
| 1,798,333 | 3/1931 | Marlowe et al. | 229/45 X |
| 1,801,389 | 4/1931 | Rumpel | 229/45 X |
| 2,768,778 | 10/1956 | Ferguson et al. | 229/45 |
| 2,850,160 | 9/1958 | Siebel et al. | 206/806 X |
| 3,814,303 | 6/1974 | Smith | 229/38 |
| 3,977,593 | 8/1976 | Rotman | 229/38 |
| 4,009,821 | 3/1977 | Hambleton | 229/38 X |
| 4,050,625 | 9/1977 | Rice et al. | 229/38 |

*Primary Examiner*—Davis T. Moorhead

[57] ABSTRACT

The disclosed carton has opposite front and back walls, a top or end panel hinged to the front wall, and a flap extending downward from the top panel inside the back wall. A tongue in the back wall is defined by side cuts and an end cut. A hang-up tab extends from the top-panel flap at a reverse bend, extending through said end cut and upward. A locking portion of the hang-up tab is wider than the tongue, thus having locking extremities. When the tab is initially shifted from inside the back wall downward through the end cut, its locking portion is disposed partly outside the tongue but the locking extremities are inside the carton. When the hang-up tab is thereafter forcibly swung outward, the locking portion flexes and its extremities emerge and lock the top panel closed. The top panel additionally has detents at the ends of its closing flap.

9 Claims, 6 Drawing Figures

SELF-LOCKING CARTONS

This invention relates to cartons designed for containing merchandise, more particularly to cartons containing merchandise and having a hang-up tab enabling the cartons to be hung from rods of a merchandise display commonly used in retail stores.

BACKGROUND OF THE INVENTION

Cartons of merchandise to be sold in retail stores often have hang-up tabs enabling the cartons to hang from horizontal rods of merchandise display apparatus.

Such cartons commonly have an end panel and a flap hinged to the end panel and tucked inside a wall of the carton. There are in-turned flaps on side walls of the carton. An incision is often provided at each end of the hinge, and details of the various flaps at the incisions cooperate to form corner detents tending to hold the end panel closed. Cartons of this kind are known and used widely. While the corner detents hold the end panel closed and prevent accidental opening, cartons of this construction are readily opened by most users, by deliberate application of opening effort.

While the cartons are still in a store, some of the merchandise is stealthily removed too frequently. Such pilferage not only causes loss of merchandise, but casts doubts on the integrity of the manufacturer.

SUMMARY OF THE INVENTION

An object of this invention resides in providing cartons with novel economical and effective locking means forming part of the carton blank for effectively resisting pilferage.

A further object of the invention resides in providing a carton with a novel hang-up tab forming an integral part of the carton blank. The novel hang-up tab avoids a window being formed through a wall of the carton as in the case of a hang-up tab cut from a wall of the carton.

A further object resides in providing a carton with a novel hang-up tab that also serves as a carton-locking tab.

The presently preferred embodiment of the invention described in detail below and shown in the accompanying drawings includes a locking tab that extends through a cut in a wall of the carton, the tab having shoulders beyond the ends of the cut so that retraction of the tab through the cut in extremely difficult. This cut defines the end of a tongue in a wall of the carton, the tongue being further defined by two side cuts. The tab has an area whose length along the tongue equals or is less than the length of the tongue and whose width is greater than that of the tongue. The tab can be shifted downward from inside the carton through said end cut, to overlie the tongue's exterior to the extent of their common areas. But because the width of the tab is oversize compared to the tongue, areas of the tab are disposed at the inside surface of the carton wall at the opposite sides of the tongue. However, the tab is easily flexed, enabling the oversized areas of the tab to be drawn outside of the carton.

In this condition of the tab, the carton is locked shut. It can be opened non-destructively only through the application of special skill, knowledge and effort. Thus, pilferage is severely inhibited.

The novel carton has a hang-up tab formed as an integral extension of a flap that extends downward from the top panel of the carton. The tab extends through a cut in a wall of the carton, and upward.

In the presently preferred novel carton, the novel integral hang-up tab is also formed to comprise the locking tab feature.

The nature of the invention and its further novel features and advantages will be more fully understood and appreciated from the following detailed description of the illustrative embodiment shown in the accompanying drawings.

DESCRIPTION OF THE DRAWINGS

FIGS. 2–5 are drawn to larger scale than FIGS. 1 and 6.

THE ILLUSTRATIVE EMODIMENT

Figure 6:
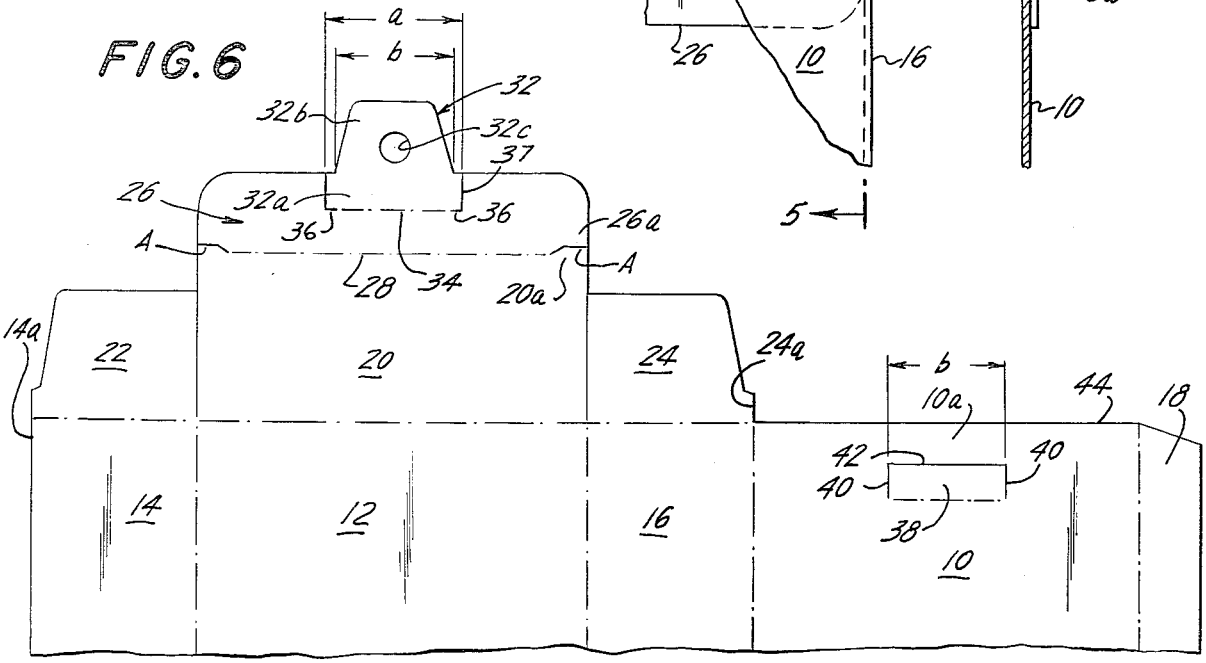
FIG. 6 is a fragmentary view of a carton blank used to make the carton of FIGS. 1–5, drawn to the same scale as FIG. 1.

In FIG. 6, the one-piece carton blank of cardboard includes a number of parts divided by creases into opposite back and front panels or walls 10 and 12, side panels or walls 14 and 16, and gluing flap 18, that constitute the body of the carton. Details of the lower end closure are not shown, being an entirely conventional form of closure of a type that cannot be opened except destructively. Top panel 20 forms an end closure at the top of the carton, joined along a crease to front wall 12. Top or end flaps 22 and 24 are joined by creases to side walls 14 and 16.

A flap generally designated 26 is divided from end panel 20 by a crease 28, and by short incisions A roughly in line with crease 28 but having short end portions angled into panel 20.

A hang-up tab generally designated 32 has a first portion **32*a* whose width a is greater than the width b of a section portion 32*b* of the hang-up tab. Hole 32*c* in portion 32*b* is to receive a suspension rod. A crease or hinged connection 34 whose length equals width b secures the hang-up tab to flap 26. Tab portion 32*a* has shoulders 36 defined by cuts through the blank in line with crease 34 extending to width a. Side edges 37 of tab portion 32*a* are parallel and are at right angles to crease 34. Portion 32*a* has only limited flexibility between its edges 37**.

Wall 10 has a tongue 38 whose end is formed by a cut 42 parallel to the upper edge 44 of back panel 10 and spaced from that upper edge by the distance between creases 28 and 34. The width b of tongue 38 is defined by parallel right angle cuts 40 extending at right angles downward from cut 42. The length of the tongue as established by cuts 40 is equal to—or slightly longer than—the length of tab portion **32*a*** measured along the hang-up tab.

Figure 1:
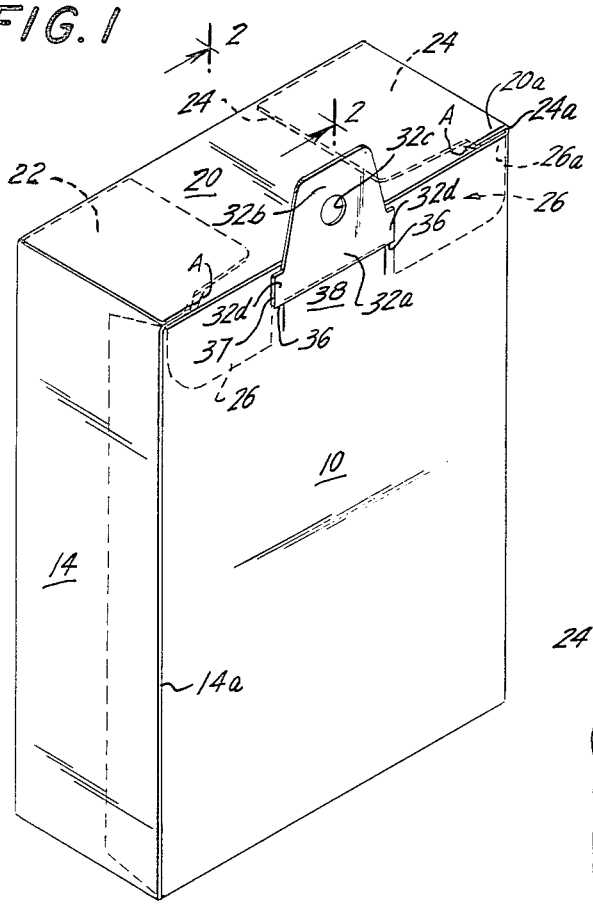
FIG. 1 is a perspective of a carton embodying features of the invention.
Figure 2:
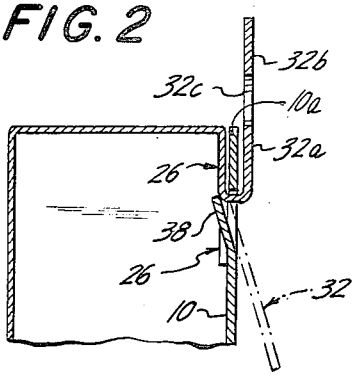
FIG. 2 is a fragmentary cross-section of the carton of FIG. 1 in a vertical medial plane designated 2—2 in FIG. 1.
Figure 3:
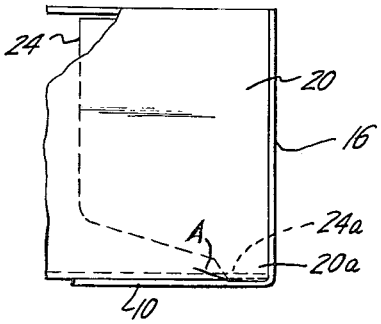
FIGS. 3 and 4 are fragmentary plan and front views, respectively, of the upper right-hand corner portion of the carton in FIG. 1.
Figure 4:
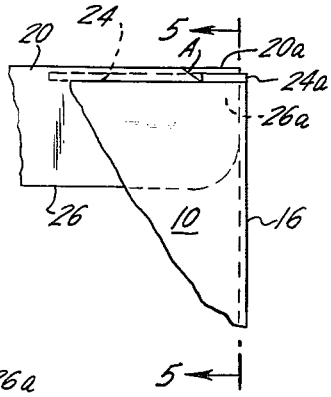
Figure 5:
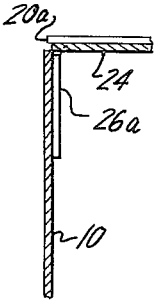
FIG. 5 is a fragmentary cross-section of the same portion viewed from the plane 5—5 in FIG. 4.

The carton is assembled by gluing flap 18 to side wall 14, incidentally leaving an exposed edge **14*a* (FIG. 1**). The lower closure is assembled and glued appropriately. After filling the carton with merchandise, end or top flaps 22 and 24 are turned in, and flap 26 together with tab 32 are bent as a unit along crease 28, and panel 20 is swung closed. In the fully closed position of the end closure, flap 26 extends along the inside of wall 10. Tongue 38 facilitates entry of tab 32 to the position represented in FIG. 2 by the phantom lines. To reach that position, tongue 38 is tilted inward a bit, and tab portion 32*b* is inserted through cut 42 (FIG. 6). Not only is the full width of the tongue opposite to tab portion 32*a*, but areas 32*d* (FIG. 1) of tab portion 32*a* extend over corresponding inside areas of panel 10 at opposite sides of the tongue since the width b of the tongue (FIG. 6) is smaller than the width a of tab portion 32*a*. Tab portion 32*a* is flexible, so that when the tab is being pulled outward or counter-clockwise from its phantom-line position in FIG. 2, tab portion 32*a* becomes bowed outward. Side edges 37 pull closer to each other, sufficiently to pass between the side cuts 40 in wall 10 defining the sides of the tongue. The tab can then be swung into its final position of FIG. 1 (the solid-line position of FIG. 2) with portion 32*b* projecting upward, clear of the end panel 20. Hole 32*c* is then in condition to receive a suspension rod of merchandise-display apparatus commonly found in retail stores. Tab 32 is connected to flap 26 by a reverse bend along crease 34, passing through cut 42. Area 32*a* of tab 32 is opposite to area 10*a* of the back panel.

While hang-up tab 32 is in the position shown in FIG. 1, it is clear that the box cannot be opened. If the carton is removed from a supporting rod, tab 32 could be swung into any attitude relative to back wall 10, and it could even be restored approximately to the phantom-line position of FIG. 2, without releasing tab 32. Areas 32*d* of flap 32 remain outside wall 10 at opposite sides of cuts 40. The hang-up tab 32 locks the end closure shut. Shoulders 36 cannot enter cut 42. The locking effect of shoulders 36 could be defeated by bowing tab portion 32*a* outward or inward sufficiently for side edges 37 to be as close to each other as cuts 40. However, that would be an operation entailing force, skill and careful attention, an operation far more exacting than that required to swing tab 32 out initally.

In common with many other cartons, the one shown in the drawings has detents that inhibit opening of the end closure. An incision A (FIG. 6) divides the top of the carton locally so as to provide a portion 20*a* overlying a jutting portion 24*a* of flap 24, while the edge of a flap portion 26*a* underlies flap portion 24*a*. Front wall 10 presses flap portion 26*a* rearward, under projecting portion 24*a* of the end flap 24. Another incision A at the opposite end of crease 28 and corresponding shapes of panel 20 and flaps 22 and 26 provide for similar retention of panel 20 at the opposite end of crease 28.

The described detents at the corners of end panel 20 hold many ordinary cartons closed (those not having hang-up tabs 32) so that they do not open accidentally. Panel 20 opens when deliberate opening force is applied. Such cartons are sometimes opened stealthily in retail stores and part of their contents removed. When that happens, the person who purchases that package is cheated and upset, the retailer may be embarrassed by complaints, and in the final analysis the manufacturer suffers loss of goodwill. However, the present carton has a locking tab extending from the in-turned flap of the carton's closing panel 20. The width a of the locking tab is greater than the width b of tongue 38 and cut 42, and the length of portion 32*a* (measured along tab 32) is not greater than the length of tongue 38. Shoulders 36 lock tab 32 against being pulled back through cut 42. Once tab portion 32*a* is swung to its position outside of panel 10, it is extremely difficult to release the hang-up tab 32. Consequently end panel 20 is locked closed effectively. The hang-up tab could be torn away after the merchandise has been sold without in any way impairing the usefulness of the carton. But so long as the merchandise is in the store and the hang-up tab is intact, there is a high degree of assurance of the integrity of the carton's contents.

The presently preferred embodiment of the invention described above is naturally amenable to modification and its novel features may be adapted to other applications by those of ordinary skill in the art. Therefore, the invention should be construed in a manner consistent with its true spirit and scope.

What is claimed is:

1. A hang-up carton having a body portion formed of plural walls including first and second walls, a top panel hinged to said first wall and forming a closure across said body portion, a flap extending from said top panel along the inside of said second wall, an incision through the second wall spaced from the top panel, and a hang-up tab secured to said flap by a hinged connection which forms a reverse bend extending through the incision when the hang-up tab is in use, said hang-up tab having a first portion disposed by said reverse bend generally along the outside of said second wall and said hang-up tab projecting above the top of said closure when the hang-up tab is in use, the projecting portion of the hang-up tab being apertured to admit a merchandise-suspending rod, the carton being proportioned so that said top panel faces upward when the carton depends from the hang-up tab.

2. A hang-up carton as in claim 1 wherein said second wall is cut to form a tongue at least as wide as said projecting portion of said hang-up tab, the end of the tongue being defined by said incision, the tongue being movable to facilitate entry of the hang-up tab through said incision.

3. A hang-up carton as in claim 1 wherein said first portion of the flap is substantially wider than said incision, said hang-up tab thereby locking said top panel closed even when said hang-up tab is swung about said hinged connection into any attitude in relation to said back wall.

4. A hang-up carton as in claim 1 wherein said first portion of the hang-up tab has shoulders extending beyond the opposite ends of said incision for obstructing retraction of said hang-up tab through said incision.

5. A hang-up carton as in claim 1 wherein said second wall has a tongue whose end is defined by said incision and whose sides are defined by a pair of spaced-apart side cuts extending from said incision in the direction away from said top panel, the length of said first portion of the hang-up tab measured along the tongue being limited to the length of said tongue, said first portion of the hang-up tab being substantially wider than the tongue and being flexible, whereby when the hang-up tab is slid through said incision and downward along the outside surface of the tongue until said hinged connection reaches the incision, the hang-up tab can be swung outward about the hinged connection, said first portion of the hang-up tab becoming arched outward during this operation so as to pass between said side cuts to be disposed outside said second wall and in condition to lock the top panel in carton-closing position.

6. A hang-up carton as in claim 4, wherein said carton includes side walls and end flaps hinged to said side walls underlying said top panel, there being incisions at the ends of the junction between the top panel and its flap, and said end flaps having portions projecting into said end incisions, underlying said top panel and overlying portions of the top-panel flap, detents thus being formed for holding the top panel closed.

7. A carton having first and second walls, an end panel forming a closure for the carton, said end panel being hinged to said first wall and having a flap extending inside the second wall, said second wall having a tongue formed therein by an end cut parallel to but spaced from said end panel and by a spaced-apart pair of side cuts extending from said end cut away from the end panel, and a locking tab extending from said flap of said end panel and through said end cut to the exterior of the carton, said locking tab being wider than said tongue so as to have lateral portions forming locking shoulders projecting outward of the ends of said end cut, said locking tab being disposed largely along the outside surface of said tongue when initially inserted through said end cut and said lateral portions of the locking tab then being disposed inside the carton, the lateral portions as measured along the tongue being limited to the length of the tongue so that the lateral portions can be drawn outside the carton through said side cuts by flexing the locking tab and swinging it outward.

8. A hang-up carton as in claim 7, wherein said carton includes side walls and end flaps hinged to said side walls underlying said end panel, there being incisions at the ends of the junction between the end panel and its flap, and said end flaps having portions projecting into said end incisions underlying said end panel and overlying portions of the end-panel flap, whereby detents are formed for holding the end panel closed despite removel of said locking tab.

9. A self-locking carton having plural panels articulated to one another including one panel having a tongue defined by an end slit and a pair of side slits extending from said end slit, said panels including a further panel, a locking tab joined to said further panel by a hinge, the hinge in the erected condition of the box being aligned with said end slit, a media portion of said tab being adapted to pass endwise through said end slit and then to overlie said tongue with said hinge in substantial alignment with said end slit, and said tab having lateral extensions projecting from the sides of said medial portion and initially underlying portions of said one panel outward of said side slits, said tab being adapted to be flexed and drawn outward so as to draw said lateral extensions into locking condition outside the carton.

* * * * *